US009763487B1

(12) United States Patent
Brown, Jr.

(10) Patent No.: US 9,763,487 B1
(45) Date of Patent: Sep. 19, 2017

(54) DOUBLE LINER IMPACT SHIELD FOOTBALL HELMET

(71) Applicant: Alphonso William Brown, Jr., Baltimore, MD (US)

(72) Inventor: Alphonso William Brown, Jr., Baltimore, MD (US)

( * ) Notice: Subject to any disclaimer, the term of this patent is extended or adjusted under 35 U.S.C. 154(b) by 468 days.

(21) Appl. No.: 13/998,193

(22) Filed: Dec. 4, 2013

(51) Int. Cl.
*A42B 3/12* (2006.01)

(52) U.S. Cl.
CPC ..... *A42B 3/122* (2013.01)

(58) Field of Classification Search
CPC ..... A42B 3/122; A42B 3/125; A42B 3/127; A42B 3/128; A42B 3/14; A42B 3/10; A42B 3/12; A42B 3/121; A63B 71/081; A63B 71/10
USPC ..... 2/713, 414, 416, 425
See application file for complete search history.

(56) References Cited

U.S. PATENT DOCUMENTS 2,194,903 A * 3/1940 Holstein ..... A42B 3/00 2/413
2,306,362 A * 12/1942 Wolff ..... A42B 3/065 2/5
2,863,151 A * 12/1958 Morgan, Jr. ..... A42B 3/127 2/414
3,237,201 A * 3/1966 Morgan ..... A42B 3/14 2/414
3,510,879 A * 5/1970 Webb ..... A42B 3/14 2/416
3,577,562 A * 5/1971 Holt ..... A42B 3/10 2/414
3,761,959 A * 10/1973 Dunning ..... A42B 3/122 137/223
4,012,794 A * 3/1977 Nomiyama ..... A42B 3/064 2/411
4,024,586 A * 5/1977 Lamb ..... A42B 3/124 2/414
4,213,202 A * 7/1980 Larry ..... A41D 31/005 2/456
4,223,409 A * 9/1980 Lee ..... A42B 3/065 2/411
4,287,613 A * 9/1981 Schulz ..... A42B 3/145 2/413
4,484,364 A * 11/1984 Mitchell ..... A42B 3/124 2/413
4,527,290 A * 7/1985 Zahn ..... A42B 3/14 2/416
4,547,919 A * 10/1985 Wang ..... A42B 3/122 2/18
4,558,470 A * 12/1985 Mitchell ..... A42B 3/124 2/414
5,101,517 A * 4/1992 Douglas ..... A42B 3/20 2/424

(Continued)

*Primary Examiner* — Alissa L Hoey

(57) ABSTRACT

The Football Helmet of the present invention will lessen the Impact Force while also lessening the transfer of momentous inertia that carries on unchanged causing concussions. This is done with cushioning by Impact Bumpers located all around the Players Head repelling impacts as they collapse. The top of the Players Head and Neck is protected because the Outer Shield of the Helmet Collapses from top impact by cushioning while repelling that force by being suspended by Springs in Keeper Boxes and also by a Sponge Pad, and Strapped Pad limiting upward thrust of the Players Head and downward thrust of the Outer shield.

1 Claim, 22 Drawing Sheets

(56) References Cited

U.S. PATENT DOCUMENTS 5,204,998 A * 4/1993 Liu ..... A42B 3/121 2/411
5,259,071 A * 11/1993 Scott ..... A42B 3/122 2/410
5,319,808 A * 6/1994 Bishop ..... A42B 3/14 2/181.2
5,815,846 A * 10/1998 Calonge ..... A42B 3/121 2/413
5,956,777 A * 9/1999 Popovich ..... A42B 3/065 2/412
6,073,271 A * 6/2000 Alexander ..... A42B 3/122 2/413
6,081,931 A * 7/2000 Burns ..... A42B 3/14 2/411
6,378,140 B1 * 4/2002 Abraham ..... A42B 3/064 2/411
7,607,179 B2 * 10/2009 Shih ..... A42B 3/20 2/411
7,930,772 B2 * 4/2011 Fontanez ..... A42C 5/04 2/425
8,533,870 B2 * 9/2013 Barth ..... A42B 3/124 2/411
8,544,117 B2 * 10/2013 Erb ..... A42B 3/122 2/410
9,179,727 B2 * 11/2015 Grant ..... A42B 3/125
2002/0166157 A1 * 11/2002 Pope ..... A42B 3/122 2/413
2005/0268383 A1 * 12/2005 Harris ..... A42B 3/121 2/413
2006/0059606 A1 * 3/2006 Ferrara ..... A01N 25/18 2/412
2008/0250548 A1 * 10/2008 Stuhmiller ..... A41D 13/0155 2/413
2008/0256686 A1 * 10/2008 Ferrara ..... A41D 13/0155 2/413
2011/0131695 A1 * 6/2011 Maddux ..... A42B 3/18 2/9
2011/0252544 A1 * 10/2011 Abernethy ..... A42B 3/121 2/413
2012/0233745 A1 * 9/2012 Veazie ..... A42B 3/121 2/413
2013/0185837 A1 * 7/2013 Phipps ..... A42B 3/12 2/2.5
2013/0283507 A1 * 10/2013 Baty ..... A42B 3/14 2/416
2014/0020158 A1 * 1/2014 Parsons ..... A42B 3/122 2/413
2016/0021965 A1 * 1/2016 Mayerovitch ..... A42B 3/12 2/414

* cited by examiner

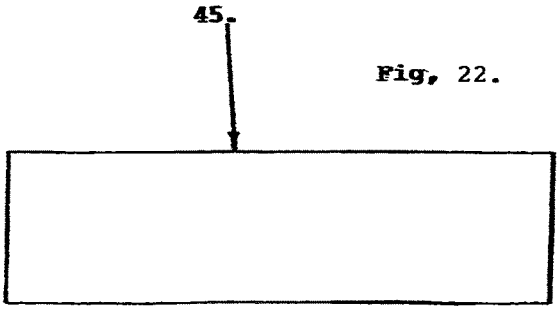
Fig, 22.
Fig.23.
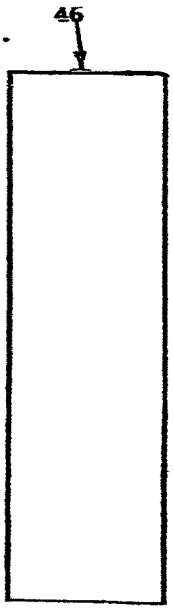
Fig.24.
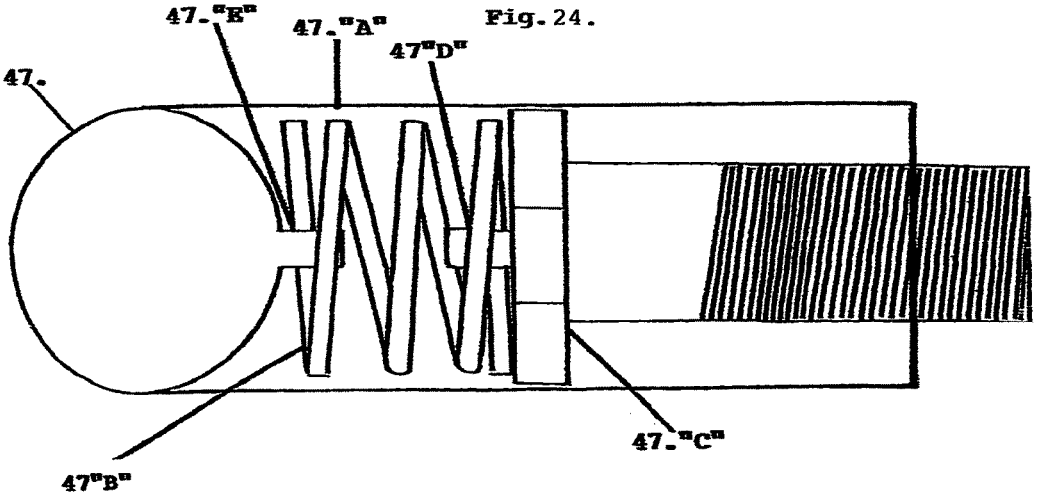

DOUBLE LINER IMPACT SHIELD FOOTBALL HELMET

BACKGROUND OF THE INVENTION

1. Field of the Invention

The present invention pertains to helmets with an inner liner shield that is designed to be secured inside the Conventional Shaped Shell that has been slightly enlarged to compensate the Inner Liner Shield. The Double Liner Impact Shield Football Helmet of the invention will provide better protection from Impacts to stronger resistance with better protection from those hard impact blows against helmet to helmet contact or from any other Impact from another players body or from the Turf giving better protection to the players Head in all areas lessening and preventing serious head injuries as concussions. Because todays Helmets are actually helping while aiding in the injuries and contributing greatly to the serious injuries as concussions that are attributed to other brain or head injuries from those very hard Impacts to the players head.

2. Description of Related Art

The reason todays Helmets are greatly responsible, is because they actually help in the transfer of that hard impact when a players head is hit by another player or as they hit the ground. That very strong violent force from Impact by those collisions can cause a severe Jarring Jolt. Helmet designs that only help to transfer the force that is carried on and into the player's skull as well as their brain causing that movement of the brain resulting in a concussion along with various other injuries to the brain. This is because the material used to make the padding inside the helmet is to absorb and cushion while supposedly protecting the players head by lessening the blow from impact. However it only really helps to intensify that blow from impact that is carried on as momentum by inertia and not cushioning or changing that force from that blow from impact because of its stiff dense foam rubber construction, and is still felt by the player with only a very small degree of protection, because again. Because there is no give or cushioning, while it does little in protecting the Players brain where that force is still felt from that momentous impact that is actually carried on by that Stiff Padding that acts to continue the force because of its high density and stiffness that aids in carrying the inertia as impact force that is then transferred directly into the skull and cranium of the player and into all the sections of the brain, jarring the brain from that impact force and bruising the players skull. All of which results in brain damage that may be mild to severe. The padding has also another strong disadvantage for being very Dense Foam therefore storing heat, from the Players Head. It also disallows the circulation of air inside the football helmet.

BRIEF SUMMARY OF THE INVENTION

However the present invention with its unique design and style allows for a better circulation of air around the players head keeping them cooler and ventilated. Another advantage of the Inner Liner Shield is with its Air Filled Padding that does not hold and store heat from the players head as the high density foam rubber padding does. The air Filled padding of the present invention will help to better protect the football players head and is lighter in weight on the Players Neck. The Inner Liner Shield of the present invention is placed inside a Football Helmet.

The Double Liner Impact Shield Football Helmet of this invention will help more in preventing the transfer of very hard impacts that cause those severe as well as mild head and brain injuries from helmet to helmet contact or from helmet impact with turf or an impact from any body parts from other players. The Inner Liner Impact Shield will provide better protection from Concussions, and many other Internal Head Injuries to the Players, as well as the External Head Injuries to the Skull.

The Double Liner Impact Shield is designed to lessen the Impact Force to a Football Players Head from the Side, Back, Front, and especially the top. It allows the Impact Force to be better absorbed, cushioned and distributed all around the players head.

Another redesign feature is a different design in the Padding that is used inside the Inner Liner Impact Shield and that is instead of the High Density Foam, I have exchanged it with Air Filled Padding which is more affective in lessening the Force from Impact on various locations around the Players Head when struck at the side, front, or back and will also lessen the momentous transfer of inertia from Impact Force. Cushioning and lessening that Force impact by minimizing the transfer of that Force in Distributing that Force from Impact as the Exertion by Inertial Energy that is carried as a driven force is neutralized.

With the Invention of The Double Liner Impact Shield Football Helmet, this Force is weakened and dispersed from its momentum under the action from that Impact Force.

My Invention called the Double Liner Impact Shield Football Helmet provides more and better protection to the Head of the Football Players, especially the Running Backs as well as the Linemen on defense and offense along with safeties, corner backs, line backers, tight ends, wide receivers and other players. Better protection because leading with the Crown of the Helmet really helps the player to block better, gain more yardage when running with the football, and putting their Heads down when preparing to make a tackle or hit leading with their head which is always in the down position for protection against Impact, which is always a natural instinct and is done instinctively by all Football Players when tackling or when being tackled.

There are two other very unique features of the Double Liner Impact Shield Football Helmet. The first is the Space between the Outer Impact Shield and the Inner Liner Impact Shield allowing for movement of the Outer Impact Shield, along with the action of the Impact Bumpers to compress as they Repel Impacts and above all the Space between the Top of the Players Head and tie Sponge Pad located up inside the Outer Shield, allowing for the Spring controlled movement as the Head moves in a vertical direction as the Outer Shield is Impacted and moving in a downward direction at the same time as the Strapped Pad prevents the players Head from violently entering that space between the Top of the Strapped Pad and the Bottom of the Sponge Pad while limiting the compression of the Sponge Pad protecting the Players Head. The second unique feature of the Double Liner Impact Shield Football Helmet is in the weight of the Football Helmet, which is very critical along with its design and the Inner Liner Impact Shield. Because not only does the design and structure of today's standard Football Helmet play a part in injuries to the Head of the Players but also the weight of today's standard Football Helmets play a very important role in contributing to a lot of the injuries sustained to the Football Players Neck and Vertebra, because of its weight as being a Heavy Object used to protect the Players Head but is more affective and lethal when used to Hit a Player Helmet to Helmet causing injuries to the Football Player. This causes the Head and Neck of both Players Injures as the weight of their Helmets play a very important part.

The Outer Shield and the Inner Liner Impact Shield are constructed with light weight composites which lightens both the Outer Wall and the Outer Shield as well as the wall of the Inner Liner Impact Shield. The Metals of the Impact bumpers are made of light weight strong and flexible Vanadium Chromium steel. The Strapped Pad is very light weight being made of Leather with the Straps being made of Elastic Canvas Straps.

BRIEF DESCRIPTION OF THE DRAWINGS

FIG. 22 is a Top View of the Swivel Head Screw in a locked position.

FIG. 23 is a Top View of the Swivel Head Screw in a neutral position.

FIG. 24 is a Cut Away Open View of the Inside of the Swivel Head Screw.

Shield without its equipment.

Figure 45:
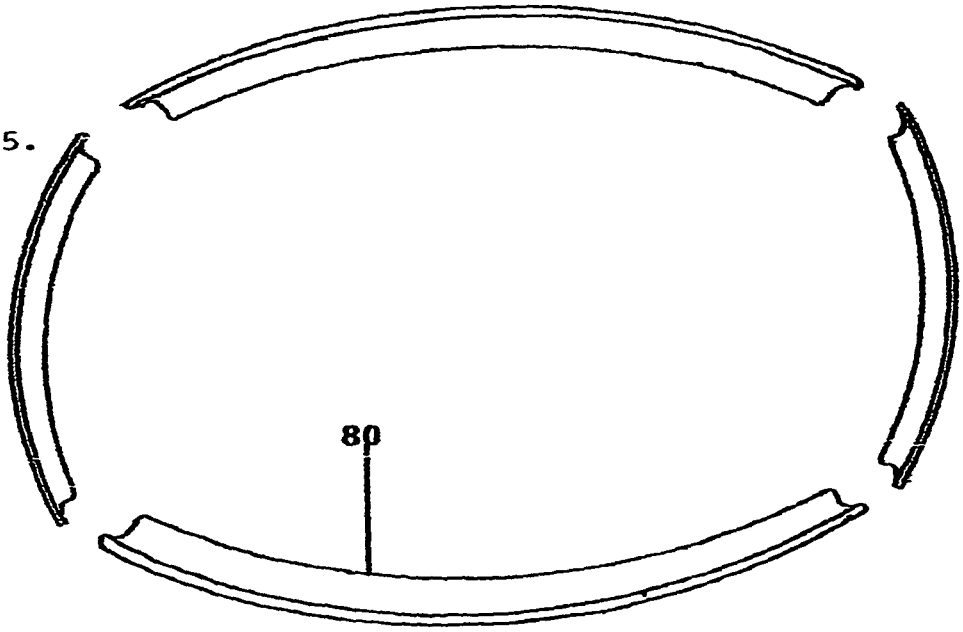

FIG. 45 is a top view of an inner liner shield without its equipment.

Figure 46:
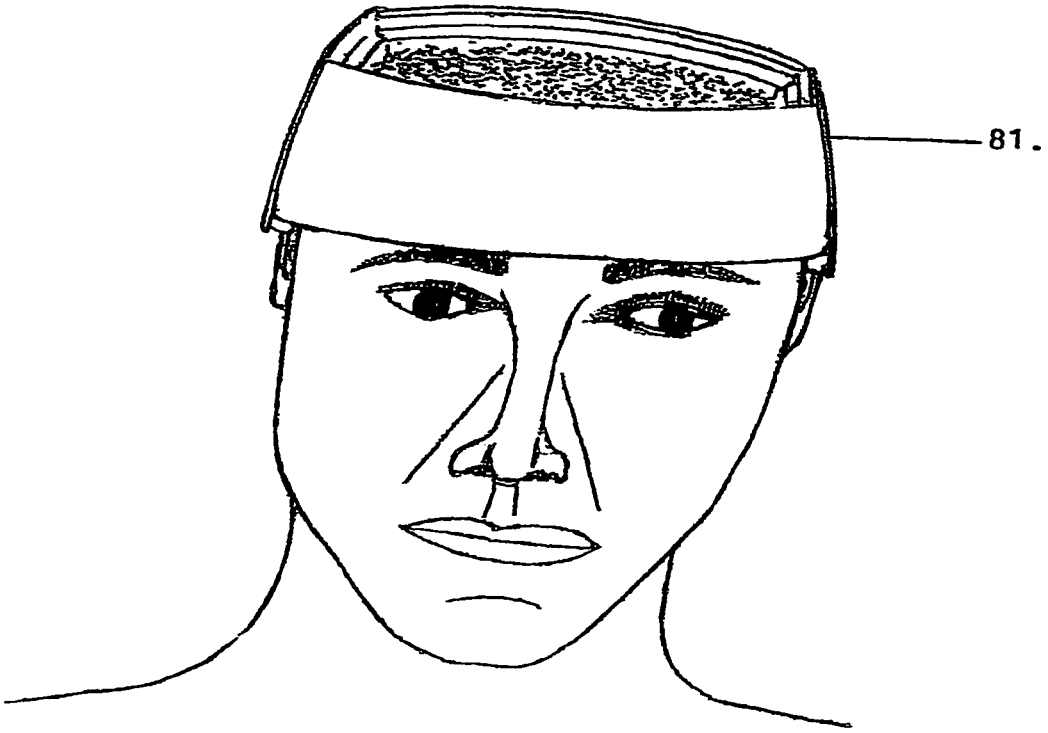

FIG. 46 is a Front View of a Football Player Wearing the Inner Liner Impact Shield, without any equipment.

Figure 47:
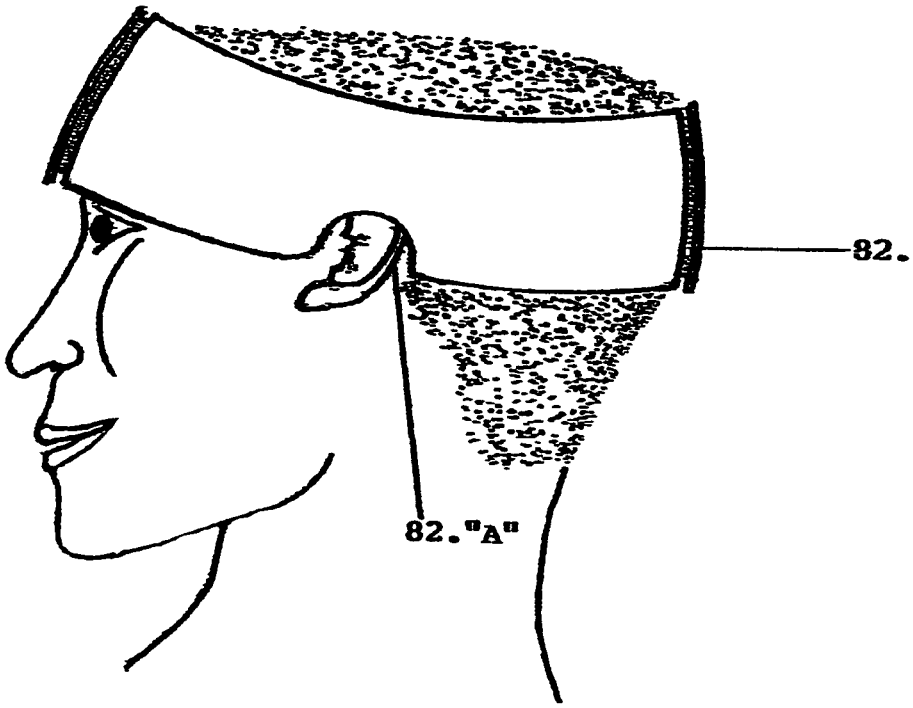

FIG. 47 is a Side View of a Football Player Wearing the Inner Liner Impact Shield, without any equipment.

DETAILED DESCRIPTION OF THE INVENTION

The Double Liner Impact Shield is designed to lessen the Impact Force to a Football Players Head from the Side, Back, Front, and especially the top. It allows the Impact Force to be better absorbed, cushioned and distributed all around the players head. This protection first starts with Twelve Impact Bumpers that are made in two different designs and sizes as viewed on drawings, the Front Secondary Impact Bumpers and the Primary Side Impact Bumpers. The Side Impact Bumper are visually larger than the Front Impact Bumper because it is designed and structured to hold two keeper boxes, a top Keeper Box and a bottom keeper box. All together there are twelve keeper boxes attached to the six primary side, impact bumpers. The keeper boxes contain a spring that is threaded through a steel lug. The impact shield has a second unique protection that allows the outer shield to move down from a top impact because it is secured and fastened to the Steel Lug attached to the spring and allowed to move because of the slit holding, carrying, and cushioning the outer shield after impact as they move down while absorbing a top blow to the helmet, as that force from Impact causes the outer shield of the Football Helmet to move down as it's cushioned by all twelve springs that are contained in their keeper boxes that are attached to the six side impact bumpers that are fastened to the inside of the Football Helmet. The Outer Shield is designed to be slightly larger than conventional helmets to allow for movement up and down easily when the top is struck or impacted. This provides the second line of protection from Impact to the top of the Football Players Head. The third line of protection is from the Strapped Pad instantly picking up the next line of protection by allowing the Players Head not to fully Impact the Sponge Pad located in the Inside top of the Outer Shield. The Top Strapped Pad is attached around the Twelve Impact Bumpers, as one of the eight straps that holds the Protective Pad protects and prevent the top of the Players Head from fully impacting the upper inside of the Outer Shield of the Football Helmet while lessening the Impact to the player.

The Sponge Pad is positioned and attached up inside the Outer Shield of the Football Helmet, providing a better protection for the Football Player than the standard Dense Foam conventional pads.

The Inner Liner Shield is attached by two screws, and together they attach the Inner Liner Shield to the Keeper Boxes. Side Impact Bumper, a top screw and the bottom screw together attach the Inner Liner Shield to the Keeper Boxes attached to the Primary Side Impact Bumpers that allow movement with the Outer Shield due to the aid of the springs in the keeper boxes. The swivel head screws attach the Keeper Boxes to the primary side impact bumpers with two rivets. One of Four Rivets used on each Side impact bumper in order to attach and secure a Keeper Box. When the Double liner Impact Shield Football Helmet is used, and a Football Player is struck on the top of the Crown, the blow pushes down the Outer Shield with the Side Impact Bumpers because together they are suspended being attached to the Inner liner Impact Shield by the Two Screws inserted into and through the wall of the inner Liner Impact Shield and into the Keeper Boxes Steel Lug that attached to a spring contained in those Keeper Box attached to the Side Impact Bumper that is held loosely at the top and bottom to allow for movement between the Inner liner Impact Shield and the Outer Impact Shield with the Side Impact Bumper being secured to the Outer Impact Shield with the screw and washer in its center, The Keeper Boxes Lug and Spring controls the Outer impact shield by suspending and limiting downward movement when the top of the Outer Shield is forced down after being struck while the Keeper Boxes Spring also limits the movement of the Inner Liner Impact Shield from moving up into the Outer Impact Shield, preventing the Players Head from fully compressing the Sponge Pad along with the help of the Strapped Pad.

The Keeper Boxes springs controlling and cushioning the Side Impact Bumpers as their Coiled Centers are Impacted and Collapse while moving their tops and bottoms as the top moves up and the bottom moves down and their coiled heads also are impacted at the same time. Along with their mounting screws that attach the Inner Liner Impact Shield to the Steel Lug in the Keeper Boxes connecting the inner Impact Shield to the Primary Impact Bumper, and the single mounting screw that attaches each Primary Impact Bumper to the Inside Wall of the outer Impact Shield of the Football Helmet.

All Twelve Impact Bumpers are also loosely attached with the swivel Head screw. The Slits at the Top and Bottom of each end after being shaped by being coiled and form Primary Impact Bumper. With these Slits cut in the top and bottom of each coiled, is to give them movement above and below the coiled center after impacted, as it then collapses further allowing the movement of the Outer Shield of the Football Helmet to move either up or down. Both Coiled Ends with a Slit allows for movement, flexibility, and a spring action to help repel and cushion the impact along with cushioning the Impact starting with the Force from the Impact compressing the Spring in the Keeper Boxes. But also by Slits at the Coiled Ends of the impact Bumper that is held in place by the Swivel Head Screw. The Slits allow for compressional movement of the coiled center of the Primary and Secondary Impact Bumpers forcing the top to move up past the shank of the Swivel Head Screw and at the time of top impact the bottom and top coil ends of the side Impact Bumper curl on impact around the head of the swivel head screw moving past the shank of the screw as it curls on compression from impact. All this movement gives a protective cushion from the front, back, and side impact. All of which is aided by the Swivel head screw and the Impact Bumpers that are held in place by the Swivel Head screw, and how it not only is used to fasten the Impact Bumpers but also to assist and aid in the movement of their coiled Ends to have free movement around the head of the Swivel Head Screw.

Hollow Shaft of the Swivel Head Screw has a spring inside the hollow shaft that gives tension between the head of the screw to Lock it in position to Lock it in the vertical or the horizontal Position. The Swivel Head Screw is fastened to a female nut on the inside wall of the Outer Shield. The Top of the Spring is connected to a small eye connector affixed to the Swivel Head or the Swivel Head Screw the connection with the top of the spring and the eye connector on the Head of the Swivel Head Screw. The connection of the Bottom of the Spring to the Top of the Hex Head Screw with an eye Connector affixed to the Top of the Head of the Rex Head Screw. The Spring is used to help lock the Head of the Swivel Head Screw in one of the canals at the Top End of the Shaft of the Swivel Head Screw as the Shaft is Hex Shaped with Six U-Shaped Cuts that are cut into the Top of the Hex Shaped Hollow Shaft with Two Canal Cuts always in line with each other in order to accept the tubular Shaped Head of the Swivel Head Screw as the Canal is used to Lock it in Position. A Canal to hold and Lock the Head of the Swivel Head Screw with the help of the Spring as the Head of the Swivel Head Screw is pulled up out of a Vertical Canal after the Impact Bumper is placed over it and positioned, the Head of the Swivel Head Screw is turned to a Horizontal. Horizontal Canal as the tension of the Spring holds it tight and snug in position as the Swivel Head holds the Impact Bumpers, movement from collapsing upon Impact assisted by the Slits that allow for movement at the Top and Bottom of the Coiled Ends of the Six Secondary Impact Bumpers attached to the Inner Liner shield.

All the Impact Bumpers have these upper and lower slits cut above and below their center coil, these Slits allowing for upward or downward movement after the Center Coil of the Impact Bumper has collapsed from an impact. However the Primary Impact Bumpers have another feature, with the Keeper Boxes that are secured to the Primary Impact Bumper. The Keeper Boxes are secured to the Inner Liner Shield by Two High Tempered Steel Screws used to connect it as they pass through the Wall of the Inner Liner Shield screwed into the Steel Lug that acts on impact as it compress the Spring that passes through it, with both contained in Keeper Box connected under a Slit on top a Primary Side Impact Bumper and over a Slit at the Bottom of a Primary impact Bumper. The Keeper Boxes attached to the Primary Impact Bumper again also provide not only Side Impact Protection, but also with the aid of movement of the Outer Impact Shield after a top impact to the crown of the Football Helmet as the Springs provide control and cushion from that downward force.

With a half inch screw and a lock washer the Inner Liner Shield is attached to the Steel Lug inside the Keeper Box that is attached to the Primary Impact Bumper, as the half inch screw that passes through the wall of the Inner Liner Shield and into the Front Hole of the Steel Lug.

The Lug and Screw are made of High Tempered Steel along with the Spring that is screwed through the top and out the bottom of the Steel Lug. The Spring and Lug are made of Vanadium Chromium Steel. The Steel Lug is centered on the Steel Spring and the Spring is Screwed through the Lug. Where the Inner Liner Shield is then attached and supported only by the Steel Lug and the Steel Spring that are housed inside the Keeper Box. The Steel Spring in the Keeper Box will provide the cushion from Impact with protection when the Top or Crown of the Football Helmet is struck by a violent strong hard blow. This protection is provided when the Helmet is struck and the Springs inside the Keeper Boxes absorb most of that strong Downward Pressure on the crown of the Helmet from the Impact allowing the Outer Shield of the Double Liner Impact Shield Football Helmet to partially compress down pass the Inner Liner Shield actually weakening and distributing the Force from Impact as the Inner Liner Shield begins to pick up the Force from the Impact that has lessened it as the next feature of the Football helmet as the Strapped Pad instantly begins to collect the Force with the next phase of the impact, preventing the players Head from Impacting the Round Sponge Pad and not allowing it to completely collapse by the Players Head further protecting the players Head by controlling the inertia and distributing the force around the players head inside the Inner Liner Shield aided by its Air Filled Padding, the strapped Pad, and the Sponge Pad. Which are all set up by the Springs in the Keeper Boxes and the Twelve Impact Bumpers.

After the initial contact from Impact the Springs inside the Keeper Boxes catches the first pressure from the force, then the Strapped Pad and the Round Sponge Pad help prevent any damage to the Top of the Players Head as the systematic reaction of the two devices, as the Strapped Pad is forced down from top Impact onto the players head as the Outer Shield is impacted and forced down cushioned by the Springs inside the Keeper Boxes that are also responsible for cushioning the Strapped Pad because the of the screws that where inserted through the wall of the Inner Liner Shield and into the Steel Lug attached to the Spring then all the Springs helping to release that pressure from Impact Force around the Players Head, and not allowing it to be focused directly to the Top of the Players Head jarring and jolting the brain. But the Springs inside the Keeper Boxes will catch and cushion the Impact Force and not allow a transfer of inertial force when a Player takes a hit from another players Helmet to Helmet Contact or when a player lands on their head, because the Springs in the Keeper Boxes cushion the Outer Shield as its moved down from Impact about a half of an inch and quickly back up into its position as the Strapped Pad is also cushioned while preventing the players Head from going up into the Top inside the Outer Shield aided by the Sponge Pad that is helping to capture and distribute the Force from Impact as the Blow to the Top of the player's head.

The spring and Steel Lug are placed inside a metal or plastic Keeper Box depending on the weight preference in keeping the Helmet comfortable when wearing it. The Keeper Box have multiple uses and is designed to not only contain or house the Spring and Steel Lug but also to enable the Steel Spring to function properly while it holds its shape for maximum affect when being compressed, while holding its position when it's being forced down from Impact and up from the compression after the Impact of the Helmet from a players hit or from ground impact allowing the Spring to maintain its shape for full strength on Impact and in its release pushing the outer Shield back up quickly into position, and straight back up. It will also have the same affect when a side blow to the Head is delivered, and the Springs in their Keeper Boxes again aids the Impact Bumpers in absorbing the force from that side impact helping in the movement of the Impact Bumpers at their Slits from the impact especially from their Center Coil. This will collapse from Impact from the side Impact along with the Top and Bottom Coils curl around the Head of the Swivel Head screw as they curl around collapsing from the impact, moving in, then out as the whole Impact Bumper is compressed at the same time at the center and at both coiled ends. All of which moves against the Springs inside their Keeper Boxes compressing them helping the Impact Bumpers Repel while they absorb that Force from the impact. The hole is tapped with a single thread also completely through to allow the Spring to pass all the way through as it's screwed onto the single thread that extends the depth of the hole. The Steel Lug also has a second hole that is located at the front of the steel lug that is drilled only half way into the steel lug and not coming in contact with the Vertical Hole, but is completely threaded in order to accept a High Tempered Steel Screw that will secure the Inner Liner Shield to the Steel Lug with the Spring that is screwed through it, with the Union of the Two contained in the Keeper Boxes that are attached to Impact Bumpers. All of which is put into action by cushioning the Players Head from the Top Impact to the Football Helmet starting with the strength of the High Tempered Steel Screw that passes through the inner liner shields Wall with a Washer to lock the Screw in position and large enough to support the Screws Head while preventing it from tearing a Hole in the Wall of the Inner Liner Shield when being pressured from the force from Impact as the Outer shield is Forced Down from Top Impact, but also from the Side Impact. That High Tempered Steel Screw not only holds the Inner Liner Impact Shield to the Steel Lug inside the Keeper Box attached to the Primary Side Impact Bumper which is fastened to the Inside of the Outer Shield of the Double Liner Impact Shield Football Helmet. The High Tempered Steel Screw must be strong enough to support and hold the inner Liner Impact Shield to the Steel Lug in the Keeper Box, but also stand up to the force from Impact Pressure to the Top of the Football Helmet. And of the many other Impacts to the Outer Shield of the Football Helmet as the compression is cushioned by the Springs as it forces down the Steel Lugs to absorb with their Springs attached inside the Keeper Boxes as they all begin the process of capturing, cushioning, while controlling and repelling the Impact Force on the Players Head.

The Sponge Pad has a hole in the Center where the top of the Players barely touches nothing on Impact accept touching the Round Section that is far softer being made of Sponge, and that the Players Head is held by the Strapped Pad and it's Eight Tension Straps making any impact to the Sponge controlled and Soft. Because the Sponge Pad is not as dense and stiff and much easier to collapse on impact as its compressed while being less likely to transfer a jarring jolt from impact. And is very easy on the Players Head when compressed from the force from Impact because the Sponge Pad is deeper and thicker yet because it's made of Sponge it is much softer than the conventional High Dense Stiff Rubber Foam Padding used in today's Football Helmets.

Another redesign feature is a different design in the Padding that is used inside the Inner Liner Impact Shield and that is instead of the High Density Foam, I have exchanged it with Air Filled Padding which is more affective in lessening the Force from Impact on various locations around the Players Head when struck at the side, front, or back and will also lessen the momentous transfer of inertia from Impact Force. Cushioning and lessening that Force impact by minimizing the transfer of that Force in Distributing that Force from Impact as the Exertion by Inertial Energy that is carried as a driven force is neutralized.

With the Invention of The Double Liner Impact Shield Football Helmet, this Force is weakened and dispersed from its momentum under the action from that Impact Force.

Figure 1:
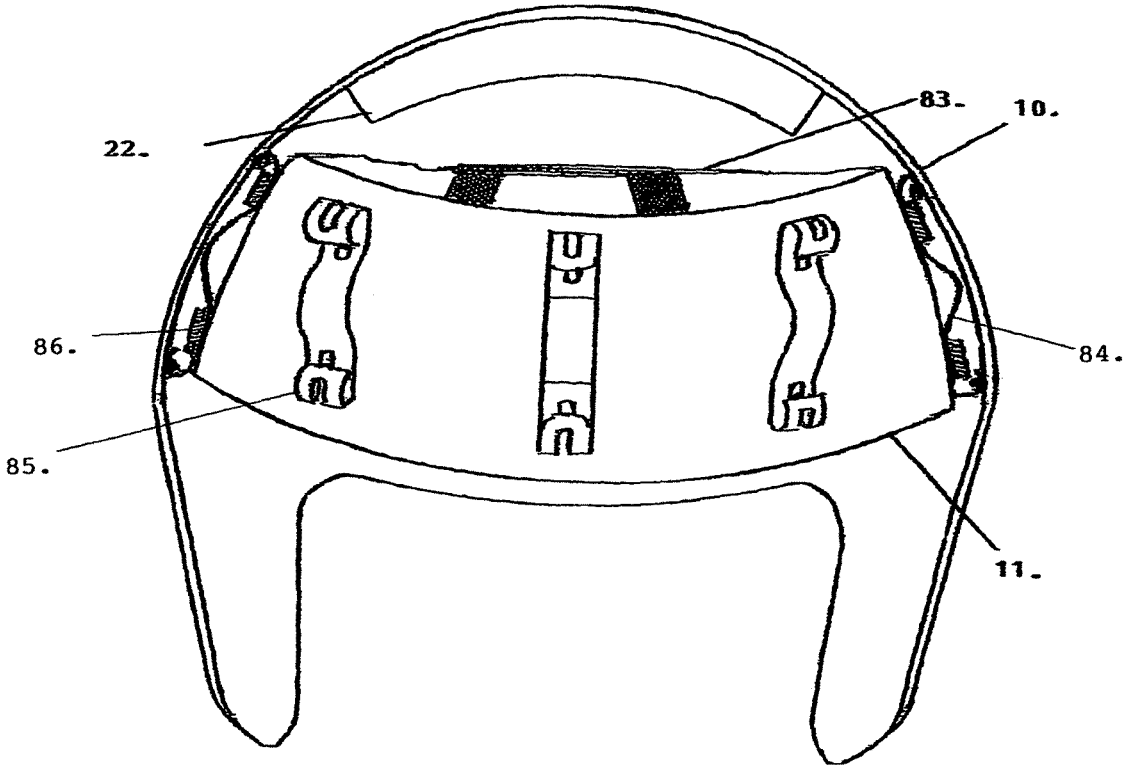
FIG. 1 is a cut away of the Outer Shield exposing the Inner Liner Shield and its parts along with the Sponge Pad.

As viewed in FIG. 1 that is a cut away inside, the operating parts of the helmet, reference character 10 as the outer Shield exposing the Inner Liner Shield reference character 11, it is the Outer Shield that moves down pass the Inner Liner Shield after Top Impact Aided and Cushioned by the Springs and the Steel Lug contained inside the Keeper Boxes reference character 86, with twelve of them attached to six Primary Side Impact Bumpers reference character 84 as a Side Primary Side Impact Bumper. The Inner Liner Impact Shield also has the Strapped Pad attached to it at its top reference character 83, which stabilizes and prevents the Players Head from thrusting Upward after that Top Impact and the Outer Shield moves down against its Springs, the Strapped Pad is working in Unison with it as it pushes down holding the Players Head as the Outer Shield is being Forced down from Top Impact. The Strapped Pad will also prevent the Players Head from fully impacting the protective Sponge Pad located up inside the Outer Shield reference character 22.

Also viewed on drawing sheet 1 is the Front Secondary Impact Bumpers attached to the Front of the Inner Liner Shield, and are the same as the Back Impact Bumpers which cushion back Impact, reference character 85 as the front. Starting with the Movable Outer Shield 10 that is suspended by the Springs as it moves down against them from Top Impact where they are contained inside Keeper Boxes attached to Primary Side Impact Bumpers reference character 84 and reference character 86 as the Keeper Box containing the Spring and Steel Lug carrying the weight of the Outer Shield as it suspends movement. This is the Cushioning affect from top impact, just as the Primary Side Impact Bumper's three coils at their top, middle and bottom gives a cushioning affect from Side Impacts because of this design helps repel the side impact. Just as the Movable Outer Shield Cushions and repels top Impacts when pushed against the Springs in their Keeper Boxes. The Secondary Front and Back also on FIG. 1 reference character 85 as one of Three Front Secondary Impact Bumpers gives a cushion to front impact as they repel hard hits. The Strapped Pad helps in holding the Players Head in place preventing upward thrust as it also prevents their Head at the Top from Impacting the Sponge. Pad reference character 22, and reference character 83 as the protective Strapped Pad, and with the Help of a Space between the two prevent the Players Head from fully Impacting the sponge Pad.

Figure 2:
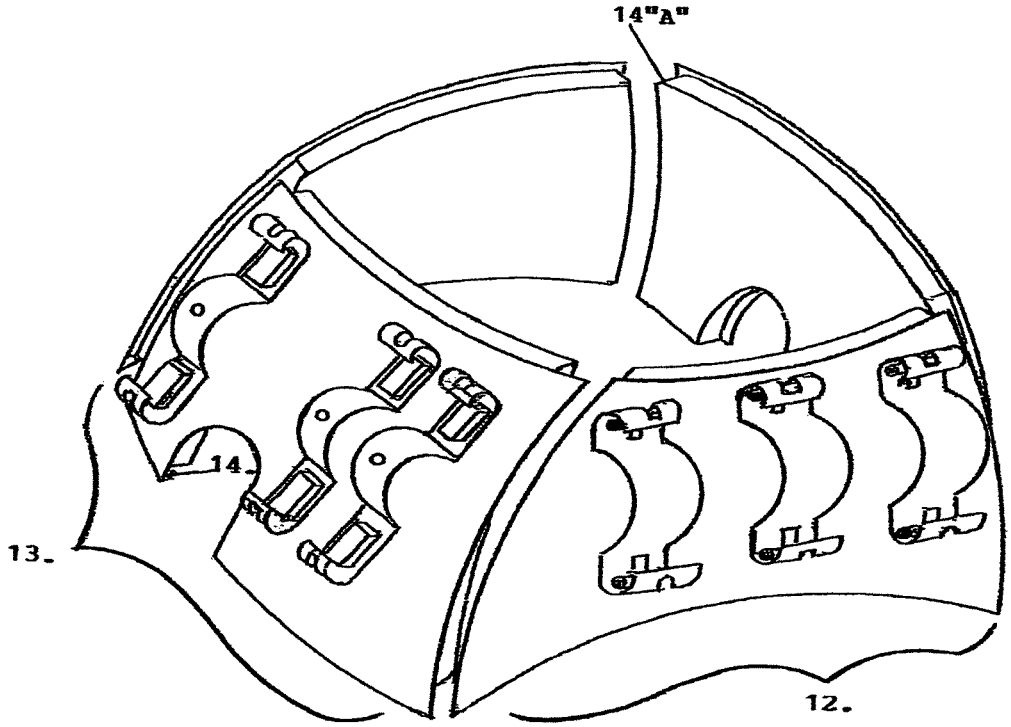
FIG. 2 is a Three Dimensional View of the Inner Liner Shield, showing its front and right side.

FIG. 2 Is a Three Dimensional View of the Inner Liner Shield, reference character 12 as the Front of the Inner Liner Impact Shield with its Three Secondary Impact Bumpers, then reference character 13 as the Right Side of the Inner Liner Shield with its Three Primary Side Impact Bumpers as they are positioned for repelling side Impact with Two in Front of the Ear Canal reference character 14, reference character 14 "A" as the Air Filled Padding that is attached to the Inside of the Inner Liner Shield where its placed against the Players Head and will provide better protection than today's stiff dense foam rubber padding.

Figure 3:
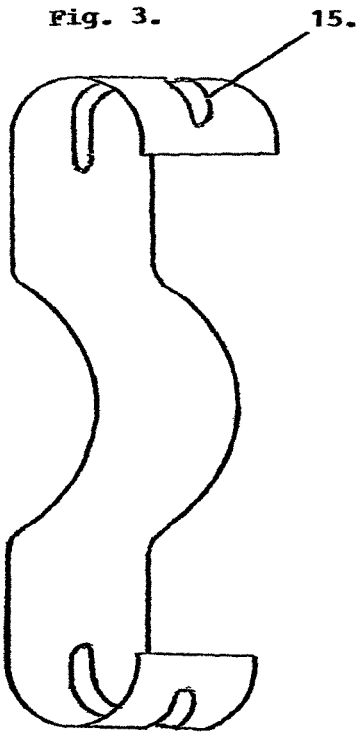
FIG. 3 is the Secondary Impact Bumper.

FIG. 3 is a view of the Secondary Front or Back Impact Bumper with its Slit reference character 1 which aids in providing collapsible movement on Impact that helps to Repel and Cushion Impacts.

Figure 4:
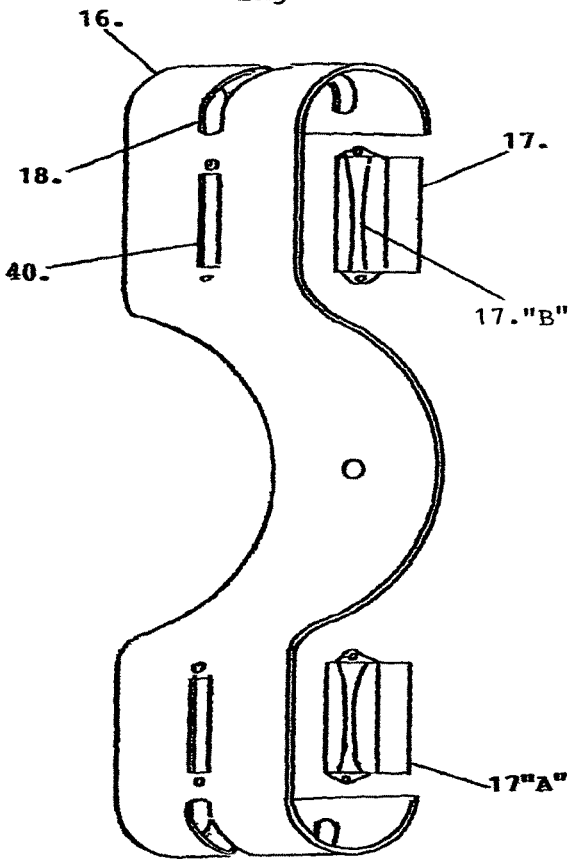
FIG. 4 is the Primary Side Impact Bumper.

FIG. 4. is a Primary Side Impact Bumper reference character 18 as its Slits that also provides the same function for collapsible movement along with the Slits at reference character 40 that allow for the movement and action of the Spring and Lug that carries and suspends the Outer Liner Shield giving it, its downward movement allowing it to collapse and retract from impact to the top of the Football Helmet. Also aided for collapsibility, cushioning, and repelling is the Coiled Ends of the Primary Side Impact Bumper reference character 16 also viewed on the Secondary Impact Bumper at FIG. 3 and just as the Secondary Impact Bumper has Slits, so does the Primary Side Impact Bumper as well, but not only at the Top and Bottom but just underneath each is a Slit reference character 40 that enables the Steel Screws to travel as viewed in FIG. 13 reference characters 32 and 33 that secures the Inner Liner to the Steel Lug contained together inside their Keeper Boxes reference characters 34 and 34"A" that are attached to the Primary Side Impact Bumper that is attached to the Inside of the Outer Shield that is pushed down on Top Impact which is allowed because of the Slits as viewed at reference character 40 where they can move up and down from top impact and retracting back into position. Also viewed in FIG. 4 is the Keeper Boxes that hold the Steel Spring and its Steel Lug reference characters 17 and 17"A", also viewed is the Front Opening of the Keeper Boxes where the Steel Screw pass through to be connected to the Steel Lug reference character 17"B" that is matched to the Slit on the Primary Side Impact Bumper at reference character 40.

Figure 5:
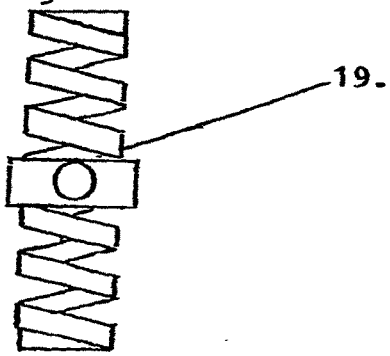
FIG. 5 is the Front View of the Steel Lug with its Steel Spring Inserted through it.

FIG. 5 is the Front View of the Steel Lug and the Steel Spring together reference character 19 and reference character 19"A" as the Threaded Hole of the Steel Lug for the Steel Screw that attaches the Inner Liner.

Figure 6:
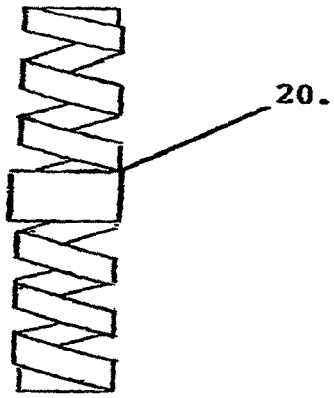
FIG. 6 is the Side View of the Steel Lug and its Steel Spring Inserted through it.

FIG. 6 is a Side View of the Steel Spring and its Steel Lug reference character 20.

Figure 7:
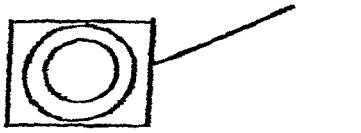
FIG. 7 is the Top View of the Steel Lug with its Steel Spring Inserted Down through it.

FIG. 7 is the top view of the steel lug and its Steel Spring together reference character 23.

Figure 8:
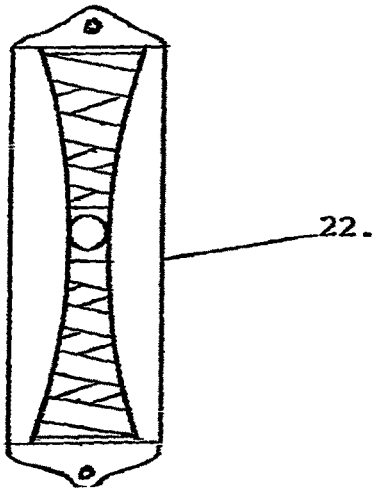
FIG. 8 is the combination of the Steel Lug and its Steel together contained inside the Keeper Box.

FIG. 8 is the Front View and how together the Keeper Box with its contained Steel Spring and the Steel Lug are connected to the Primary Side Impact Bumper at its Slit as viewed in FIG. 4, reference character 40.

Figure 9:
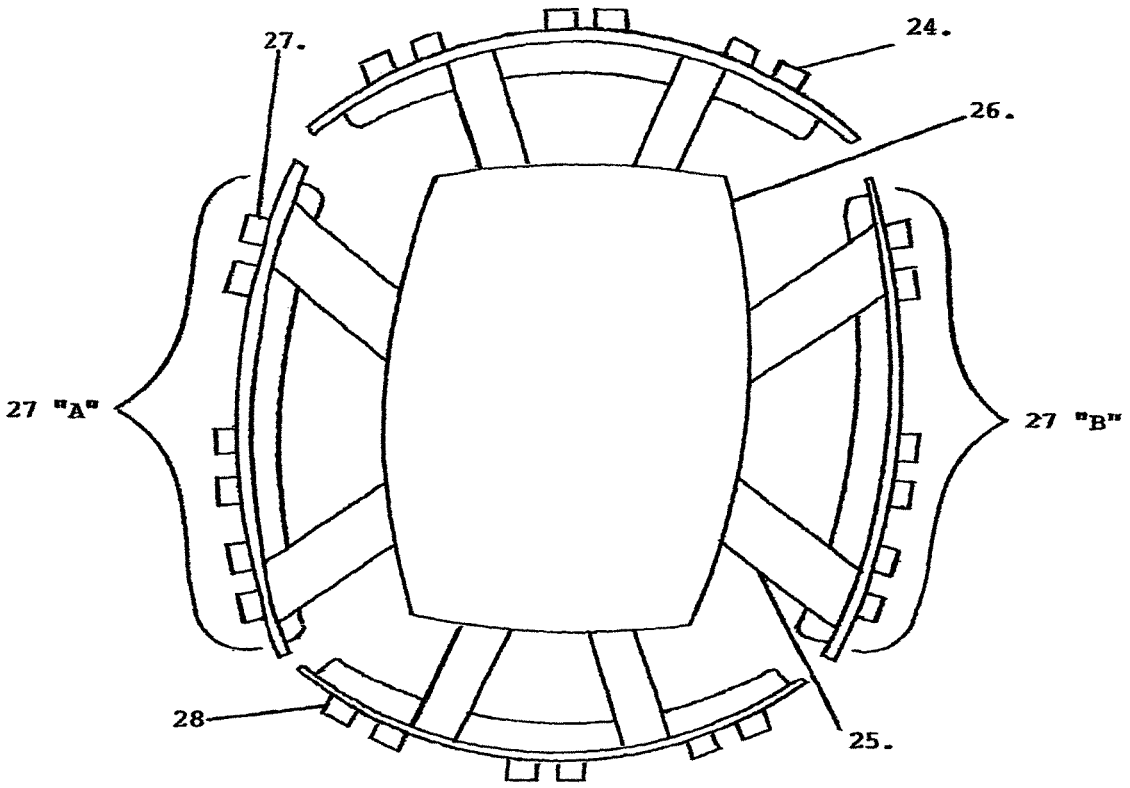
FIG. 9 is a Top View of the Inner Liner Shield, and it's Strapped Pad.

FIG. 9 of the Inner Liner Impact Shield reference character 27 as one of three Primary Side impact Bumpers viewed together reference character 27"A" attached to the right side section of the Inner Liner Impact Shield and reference character 27"B" as the left side section of the Inner Liner Impact Shield along with its three Primary Side Impact Bumpers. Then reference character 26 as the Protective Strapped Pad and reference character 25 as one of eight Straps attached to the four Sections of the Inner Liner Impact Shield.

Figure 10:
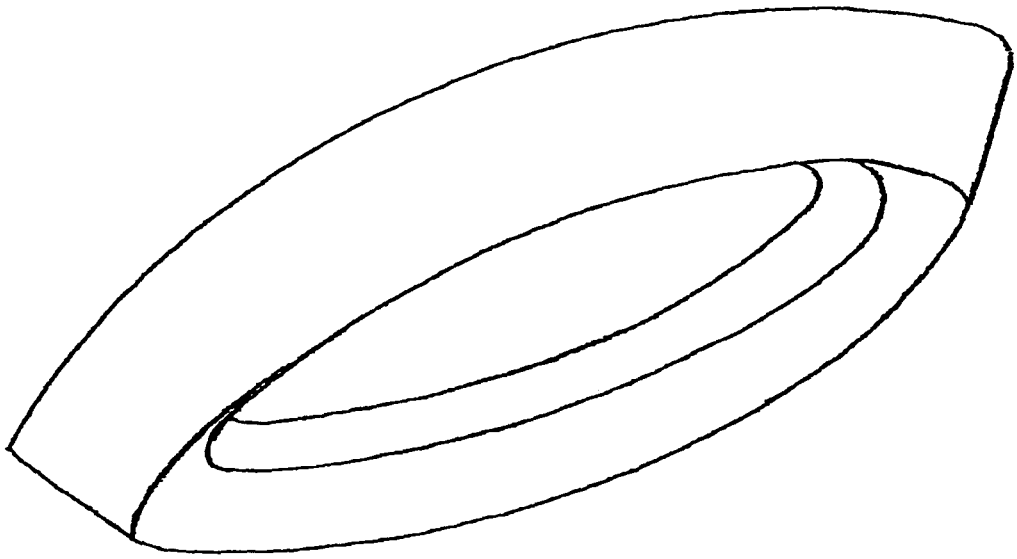
FIG. 10 Three Dimension View of the Sponge Pad.

FIG. 10 is a Three Dimensional View of the Protective Soft Sponge Pad that is attached up inside the outer Impact Shield to protect the players Head from a upward thrust from top impact to the Outer Impact Shield as its being forced down applying pressure to the Springs in the Keeper Boxes as they cushion a top impact that Forces down the Inner Liner Impact Shield along with its Strapped Pad limiting that Upward Thrust of the Players Head into the Soft Sponge Pad, again as they work together in unison providing better protection for the Football Players Head.

Figure 11:
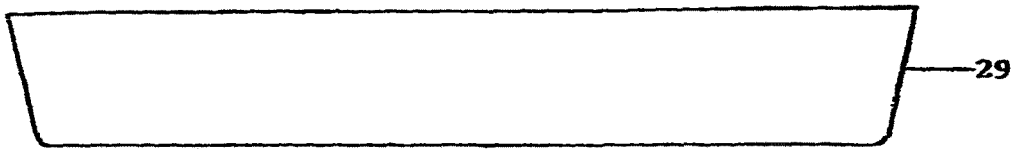
FIG. 11 is a Side View of the Sponge Pad.

FIG. 11 reference character 29 as the side view of the Soft Sponge Pad that is attached Up inside the Outer Impact Shield to help limit injuries to the Players Head when they receive a top impact to their Helmet.

Figure 12:
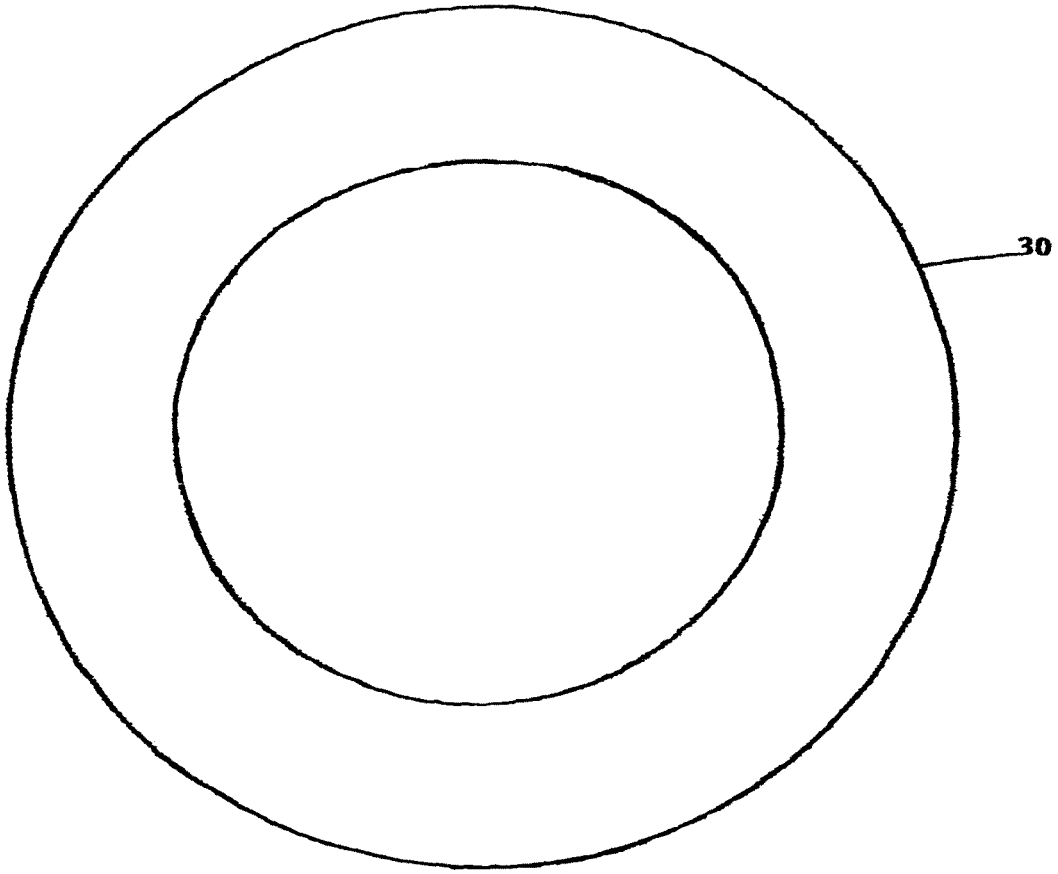
FIG. 12 is a Top View of the Sponge Pad.

FIG. 12 is a top view of the Soft Sponge Pad reference character 30.

Figures 13, 14, 15:
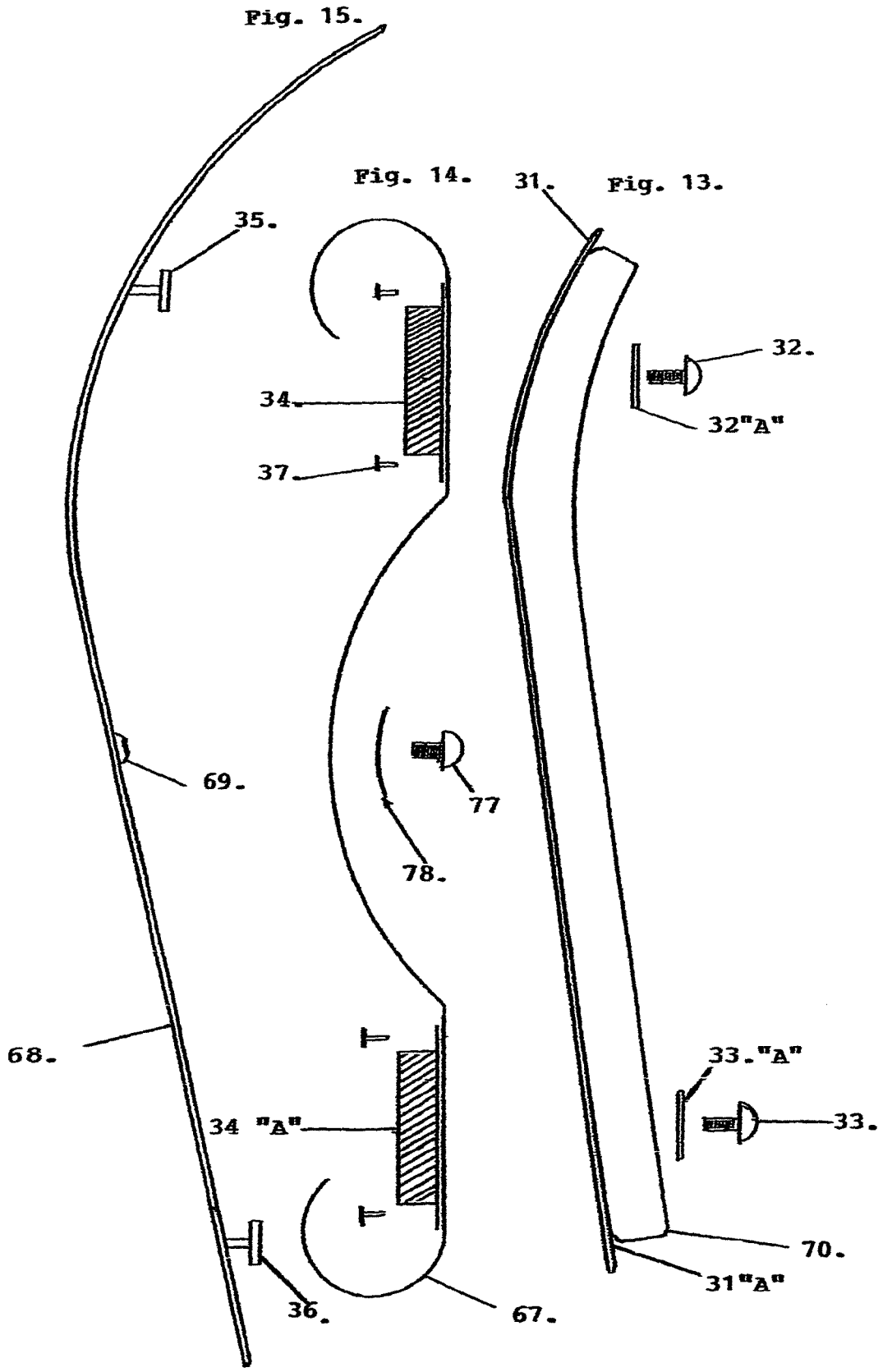
FIG. 13 is the Inner Liner Shield.
FIG. 14 is a Primary Side Impact Bumper.
FIG. 15 is the Outer Shield of the Double Liner Impact Shield Football Helmet.

FIG. 13 is the Inner Liner Impact Shield reference character 31 reference character 31"A" as the Protective Wall, reference character 32 as a Steel Screw used to attach it to the Steel Lug inside the Keeper Box along with a Lock Washer reference character 32"A" also helping to attach the Inner Liner Impact Shield is the bottom screw at reference character 33 and its lock washer reference 33"A", then reference character 70 that is the Air Filled Padding that is against the Players Head and Face to provide a better protection than the High Density Stiff Foam Rubber Padding that is used today.

FIG. 14 is the Primary Side Impact Bumper reference character 34 as the top keeper box and reference character 34"A" as the Bottom Keeper Box and reference character 37 as one of four rivets with two used to attach one Keeper Box. Then reference character 77 as a Steel Screw and reference character 78 as a Lock Washer, and together they attach the Primary Side Impact Bumper to the inside wall of the Outer Impact Shield at a female nut reference character 69.

FIG. 15 is the Outer Impact Shield of the Double Liner Impact Shield Football Helmet reference character 68, then reference characters 35 and 36 as two of twelve Swivel Head Screws used to loosely attach the Primary Side Impact Bumpers.

Figure 16:
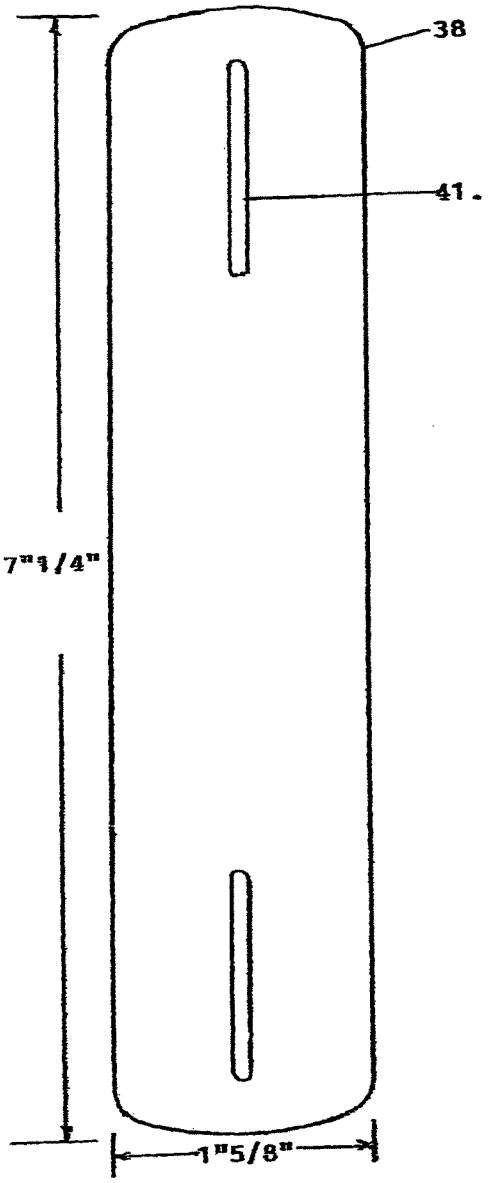
FIG. 16 is the Secondary Front or Back Impact Bumper Unshaped.

FIG. 16 is a Secondary Impact Bumper before being shaped and formed with coiled top and bottom ends along with a coiled center, all of which will be used to later cushion and repel Impacts.

Figure 17:
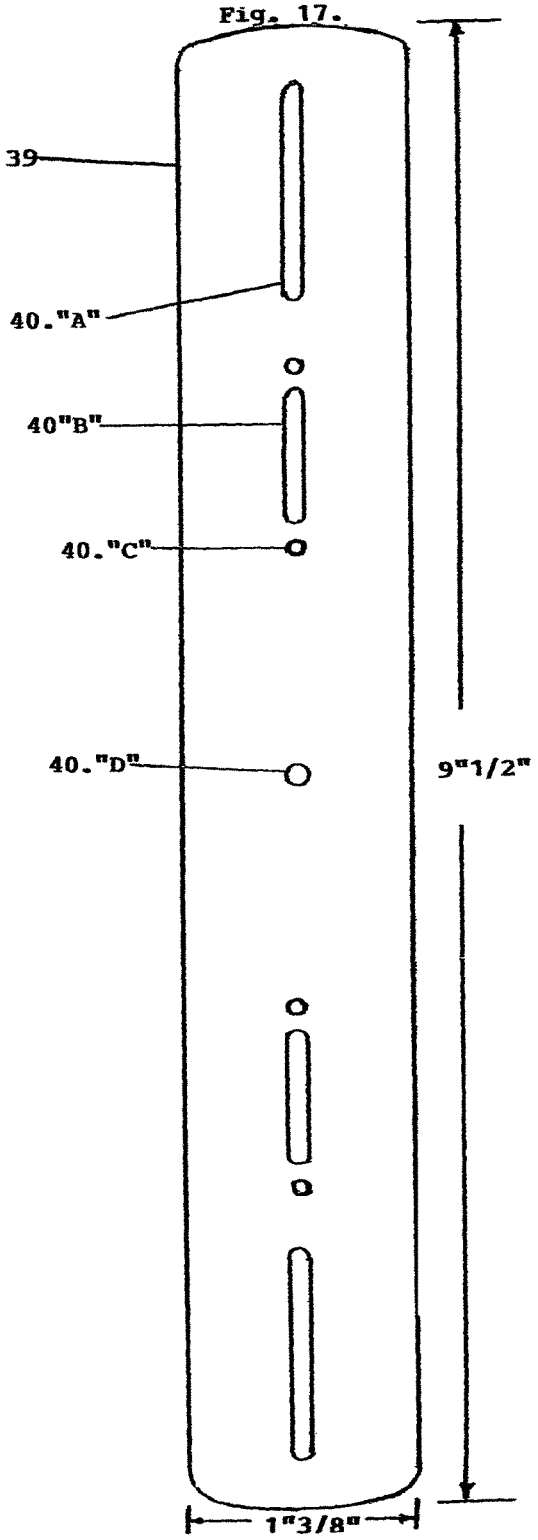
FIG. 17 is the Primary Side Impact Bumper Unshaped.

FIG. 17 is a side impact bumper also viewed before being shaped and formed, reference character 39, then reference, character 40"A" as the Top Slit reference character as one of the two slits used for the movable Screw in the Steel Lug contained in the Keeper Box as the opening on the Keeper Box will be mated with the Slit at reference character 40"B" attached at one of four Screw Holes reference character 40"C". And reference character 40"D" is the Screw Hole to attach the Impact Bumper to the Inside Wall of the Outer Shield of the Double Line Liner Impact Shield Football Helmet.

Figure 18:
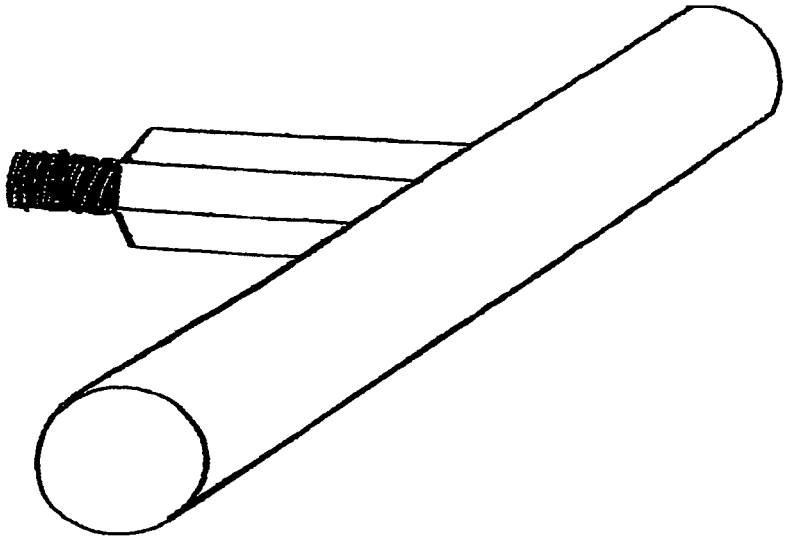
FIG. 18 three dimensional view of the Swivel Head Screw.

FIG. 18 is a three dimensional view of the Swivel Head Screw used to loosely attach the twelve Impact Bumpers that are positioned around the Inner Liner Impact Shield.

Figure 19:
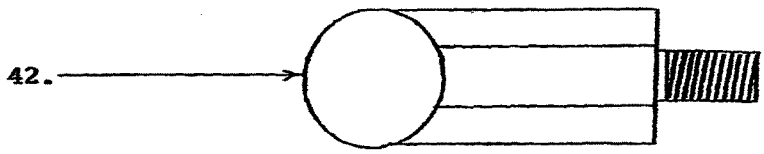
FIG. 19 is a Side View of the Swivel Head Screw.

FIG. 19 is a Side View of the Swivel Head Screw reference character 42.

Figure 20:
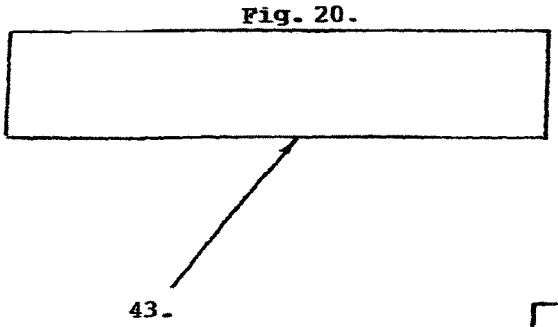
FIG. 20 is a Top View of the Swivel Head screw.

FIG. 20 is a Top View of the Swivel Head Screw reference character 43.

Figure 21:
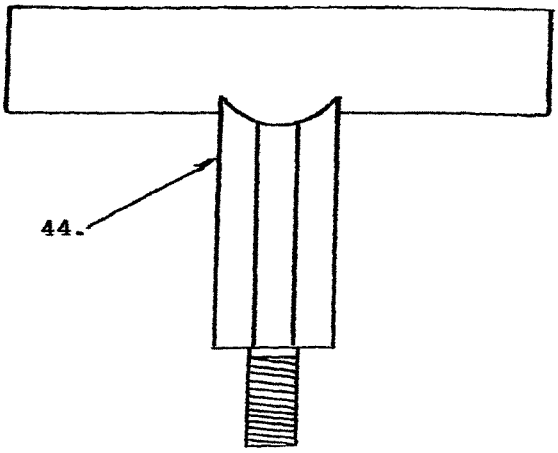
FIG. 21 is a Front View of the Swivel Head screw.

FIG. 21 is a Front View of the Swivel Head Screw reference character 44.

FIG. 22 is the Locking Position of the Swivel Head Screw reference character 45.

FIG. 23 is the Neutral Position of the Swivel Head Screw reference character 46.

FIG. 24 is a cut away Open View of the working parts of the Swivel Head Screw reference character 47 as the Head of the Swivel Head Screw, then reference character 47"A" as the Hollow Hex Shaped Shaft of the Swivel Head Screw, reference character 47"E" as the Eye Connector attached to the Head of the Swivel Head Screw that is used to Thread an attach the Top Curl of the Spring inside the Hollow Shaft reference character 47"B" then reference character 47."D" as an Eye Connector attached to the Top of the Hex Head Screw reference character 47"C" is the Head of the Hex Head Screw, and reference character 47"F" that is the Bottom Curl of the Spring that is attached to the Eye Connector on the Top of the Hex Head Screw.

Figure 25:
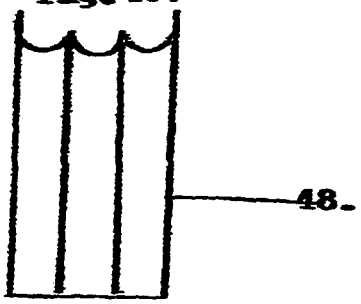
FIG. 25 is the Shaft of the Swivel Head Screw in a front view.

FIG. 25 is a Front View of the Hollow Shaft of the Swivel Head Screw, reference character 48.

Figure 26:
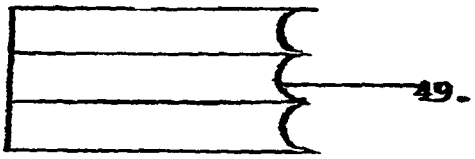
FIG. 26 is the shaft of the swivel head screw in a Side view.

FIG. 26 is a Side View of the Hollow Shaft reference character 49 of the Swivel Head Screw.

Figure 27:
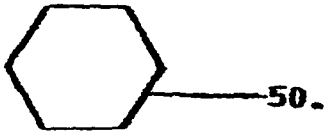
FIG. 27 a Top View of the Swivel Head.

FIG. 27 is a Top View of the Hollow Shaft of the Swivel Head Screw reference character 50.

Figure 28:
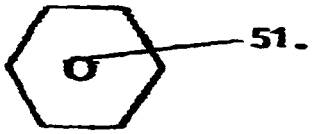
FIG. 28 is a Bottom View of the Swivel Head Screws Shaft.

FIG. 28 is a Bottom View of the Hollow Shaft of the Swivel Head Screw reference character 51.

Figure 29:
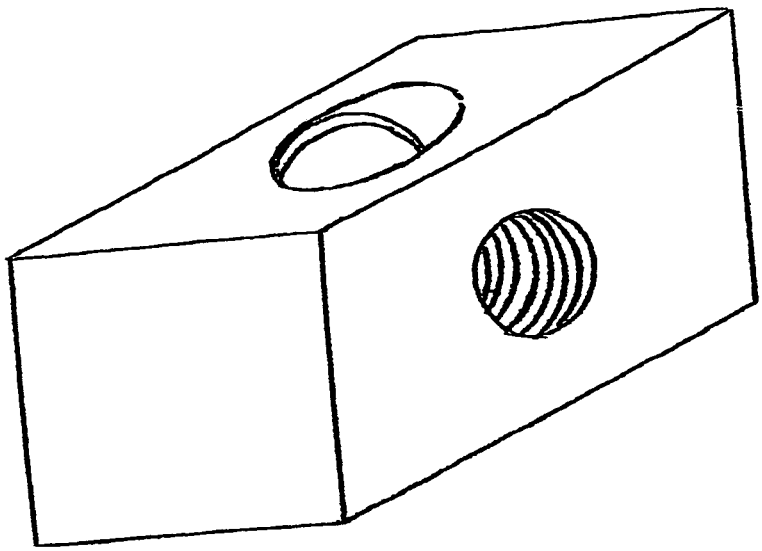
FIG. 29 is a three dimensional full view of the Steel Lug.

FIG. 29 is a three dimensional view of the Steel Lug that is used with a Steel Spring with both unified together and contained inside the Keeper Box to in order carry and suspend the outer shield so that it can function by collapsing and retracting after Top Impact to the Double Liner Impact Shield Football Helmet.

Figure 30:
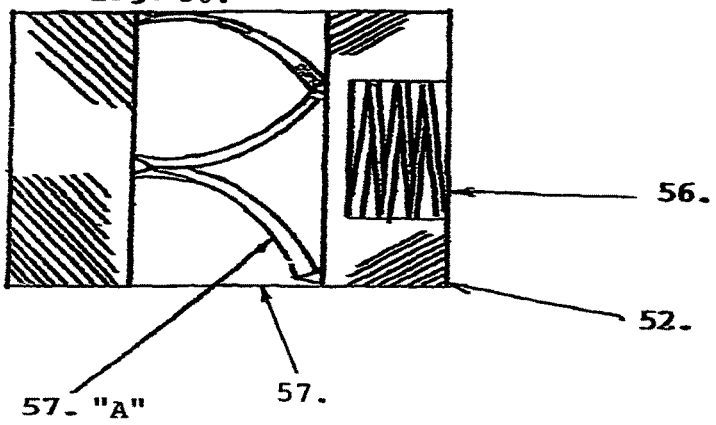
FIG. 30 is a side view cut away of the Steel Lug.

FIG. 30. is a cut away open view of the Steel Lug reference character 52,
reference character 56 is a view of the partial Horizontal Hole that is fully threaded to accept the Steel Screw that will attach the Inner Liner Shield to the Steel Lug, reference character 57 that is a Larger Vertical Hole that extends completely through the Steel Lug that is partially threaded with only a single thread that is tapped completely through the hole, reference character 57"A".

Figure 31:
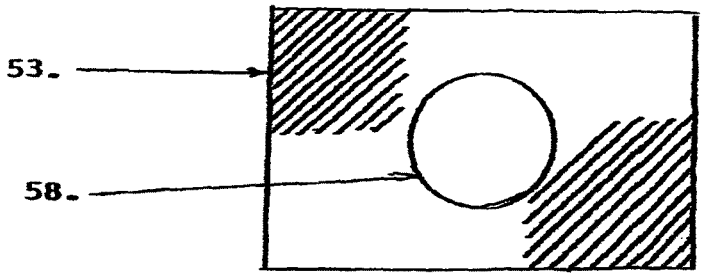
FIG. 31 is a Front View of the Steel Lug.

FIG. 31 is a Front View of the Steel Lug reference character 53, and reference character 58 that is the Horizontal Hole used for the Steel Screw to attach the Inner Liner Shield to the Steel Lug and its Spring.

Figure 32:
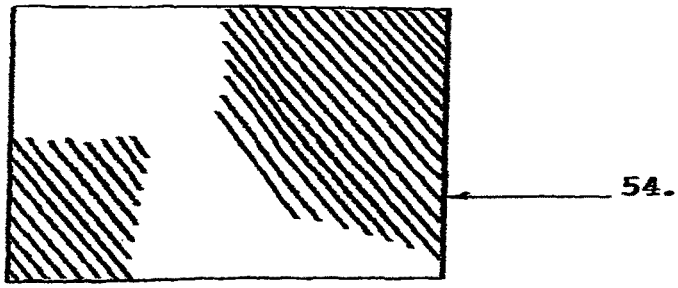
FIG. 32 is a Side View of the Steel Lug.

FIG. 32 is a Side View of the Steel Lug reference character 54.

Figure 33:
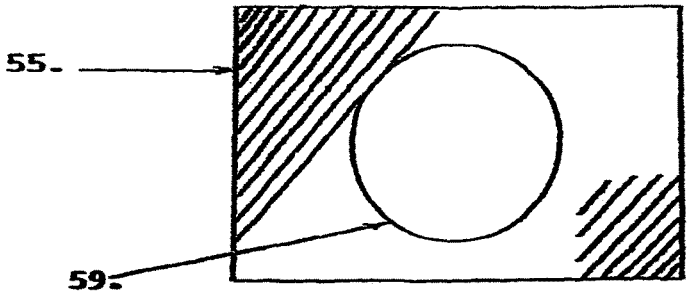
FIG. 33 is a Top View of the Steel Lug.

FIG. 33 is a Top View of the Steel Lug reference character 55, then reference character 59 is a Vertical Hole that extends completely through the Top and out the Bottom with a Single Thread to attach the Steel Spring to the Steel Lug.

Figure 34:
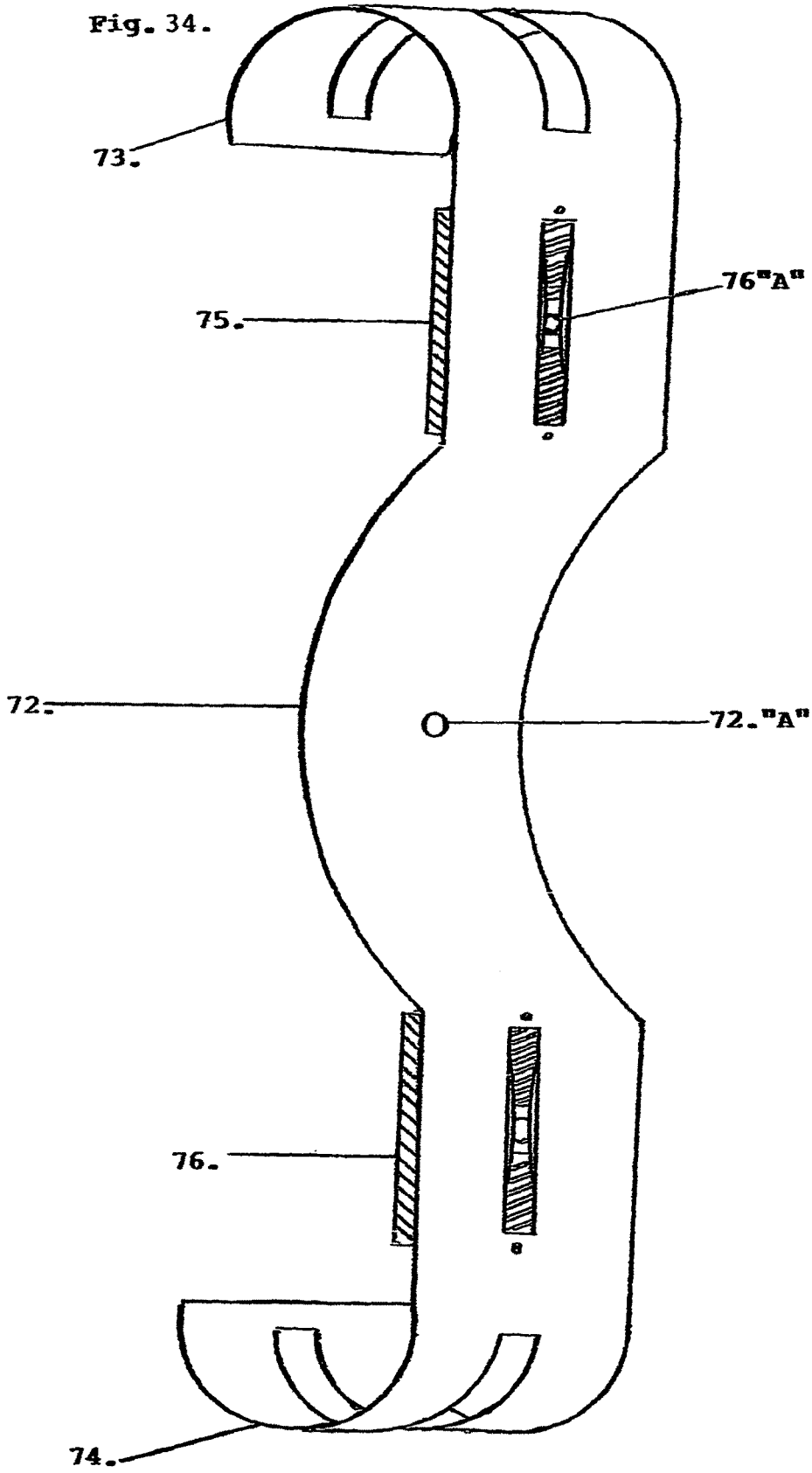
FIG. 34 is a Full View in Three Dimension of the Primary Side Impact Bumper.

FIG. 34 is a View of the Primary Side Impact Bumper that has been shaped and formed with its Top Coiled end reference character 73, and its bottom coiled end reference.

FIG. 34 character 74 then reference character 72 as its Center Coiled section and reference character 72"A" as the drilled hole that is used for a Steel Screw used to attach the Primary Side Impact Bumper to the Inside Wall of the Outer Shield as viewed in FIG. 15, reference character 69 that is the Female Nut to accept the Steel Screw on FIG. 14,
reference character 77, and FIG. 14 is the Primary Side Impact Bumper being attached. Also on FIG. 34 reference character 75 is the Top Keeper Box attached to the Primary Side Impact Bumper and reference character 76 as the Bottom Keeper Box attached to the Primary Side Impact Bumper, then reference character 76"A" as a Slit that will allow the Steel Screw to travel up and down with the Steel Lug with the action of the Steel Spring that is attached inside the Steel Lug as the Steel Spring allows for it to Move on Top Impact to the Helmet as it also moves Down and Back Up in position, after Impact.

Figure 35:
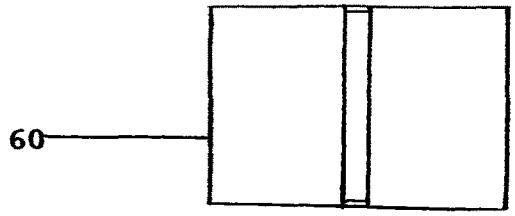
FIG. 35 is a Top View of the Secondary Front or Back Impact Bumper.

FIG. 35 is a Top View of the Secondary Front or Back Impact Bumper reference character 60.

Figure 36:
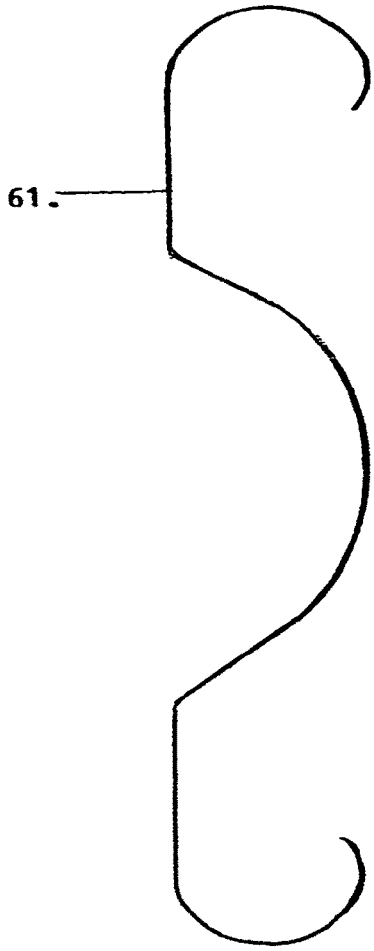
FIG. 36 is a Side View of the Secondary Front or Back Impact Bumper.

FIG. 36 is a Side View of the Secondary Front or Back Impact Bumper after being shaped and formed reference character 61.

Figure 37:
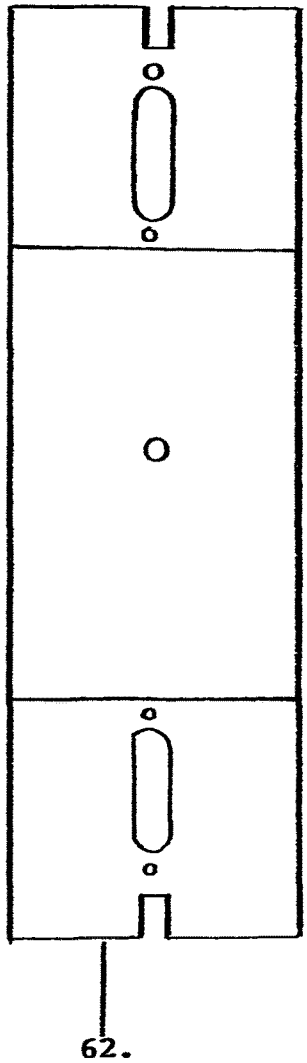
FIG. 37 is a Back View of the Secondary Front or Back Impact Bumper.

FIG. 37 is a Back View of the Secondary Front or Back Impact Bumper, reference character 62.

Figure 38:
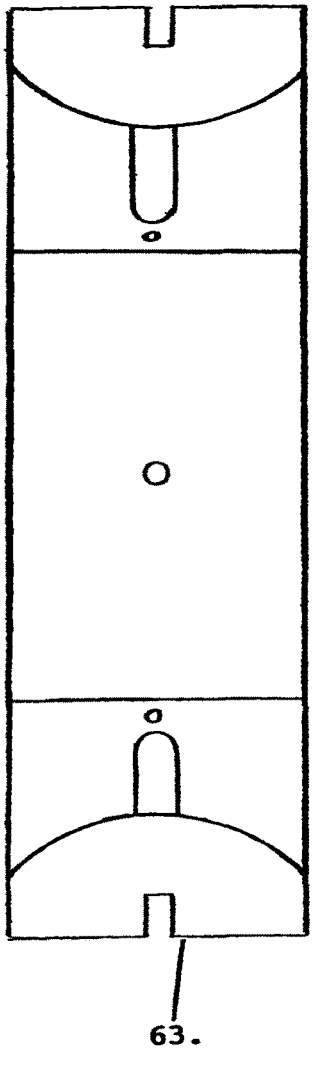
FIG. 38 is a Front View of the Secondary Front or Back Impact Bumper.

FIG. 38 is a Front View of the Secondary Front or Back Impact Bumper, reference character 63. The Secondary Impact Bumpers that are smaller than the Primary Side Impact Bumpers and have no Keeper Boxes, are attached three to the back of the Inner Liner Shield and three to the Front of the Inner Liner Impact Shield as viewed in FIG. 9, reference characters 24, at the back of the Inner Liner Shield and reference characters 28, the Front of the Inner Liner Shield.

Figure 39:
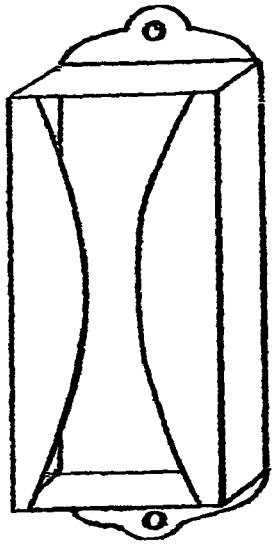
FIG. 39 is a three dimensional full view of the Keeper Box.

FIG. 39 is a three dimensional view of a Keeper Box used for the Steel Lug and Steel Spring that are fastened together and then placed inside the Keeper Box where a Steel Screw attaches the Inner Liner Shield to the Steel Lug and together with the Steel Spring they work in unison to carry the weight of the Outer Shield while suspending it that allows it to Collapse Down from a Top Impact and to also retract back up into position for the next.

Figure 40:
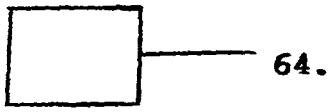
FIG. 40 is a Top View of the Keeper Box.

FIG. 40 is a Top View of the Keeper Box reference character 64.

Figure 41:
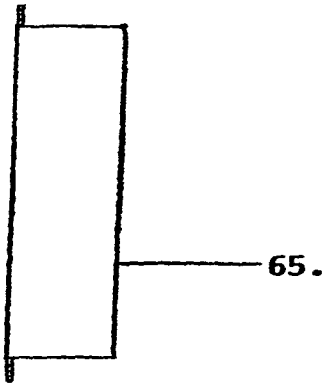
FIG. 41 is a Side View of the Keeper Box.

FIG. 41 is a Side View of the Keeper Box reference character 65.

Figure 42:
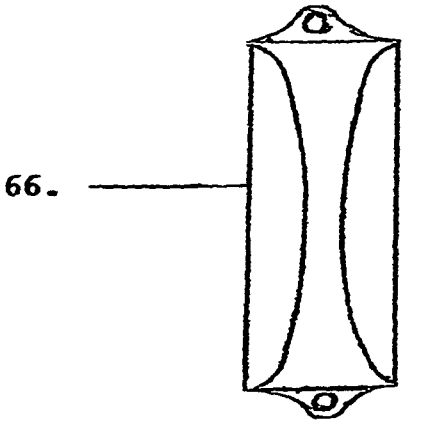
FIG. 42 is a Front View of the Keeper Box.

FIG. 42 is a Front View of the Keeper Box reference character 66.

Figure 43:
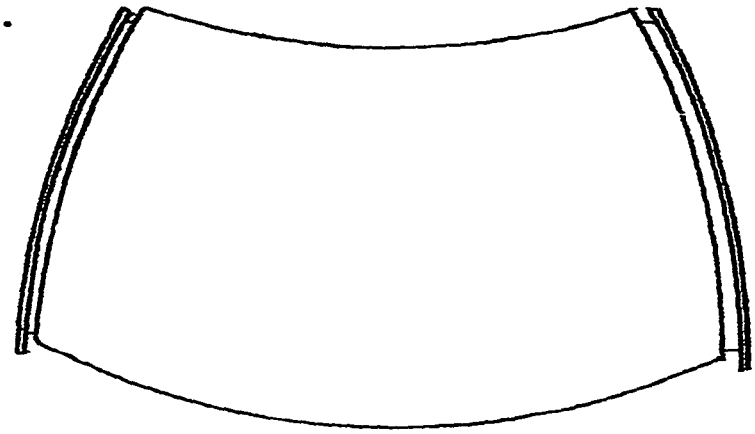
FIG. 43 is a Back View of the Inner Liner Shield without equipment.

FIG. 43 is a Back View of the Inner Liner Impact Shield without equipment that are the Impact Bumpers.

Figure 44:
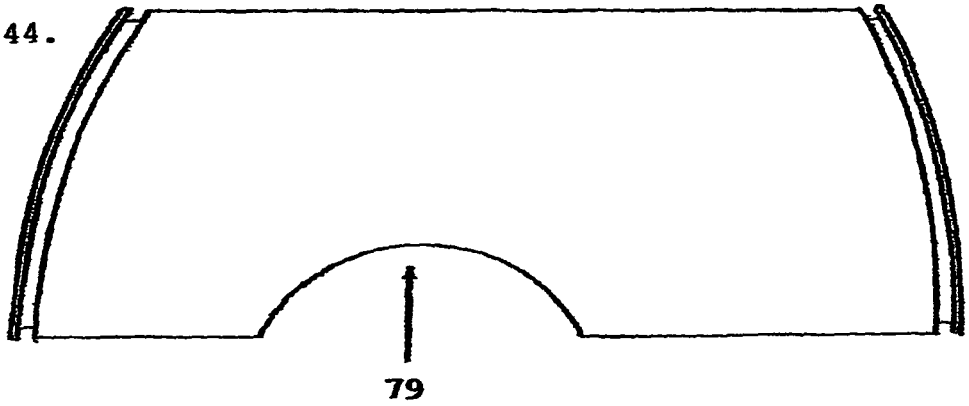
FIG. 44 is a Side View of the Inner Liner Shield without its equipment.

FIG. 44 is a Side View of the Inner Liner Impact Shield without equipment that are the Impact Bumpers. This View shows the Ear Canal which provides a safe area for the Players Ear while also allowing for a more comfortable Fit of the Football Helmet.

FIG. 45 is a Top View of the Inner Liner Impact Shield with its four section without equipment that are the twelve Impact Bumpers but only viewing the Air Filled Protective Padding reference character 80.

FIG. 46 is a Front View of a Football Player wearing the Inner Liner Impact Shield only, and not the Outer Impact Shield or any of the equipment, reference character 81.

FIG. 47 is a Side View of a Football Player wearing the Inner Liner Impact Shield only, and not the Outer Impact Shield or any of the equipment only the Inner Liner Impact Shield reference character 82, and reference character 82"A" that is the Players Ear in the Ear Canal of the Inner Liner Impact Shield providing protection and, comfortableness while wearing it.

What is claimed is:

1. A football helmet system comprising:

an outer impact shield forming the outer surface of the football helmet;

an inner liner impact shield comprising a protective wall and an air filled pad attached to the protective wall, the inner liner impact shield having four separate sections that are connected together, the four separate sections of the inner liner comprise a front section, a back section and two side sections, a plurality of holes are formed through the inner liner impact shield to receive a plurality of screws;

a plurality of impact bumpers each comprising top and bottom coiled ends and a plurality of slits cut into the top and the bottom of the coiled ends, the plurality of slits are configured to allow for collapsibility of the impact bumpers, the impact bumpers each comprising top and bottom keeper boxes attached to an outside surface, the top and bottom keeper boxes comprise steel lugs configured to retain the plurality of screws threaded through the plurality of holes formed through the inner liner impact shield connecting the inner liner impact shield and the impact bumpers together, the impact bumpers are fastened to and between the outer impact shield and the inner liner impact shield, wherein the plurality of impact bumpers are attached to the outer impact shield by a screw extending through a middle of each impact bumper and into a female nut attached to an inside wall of the outer impact shield, and the top and bottom coiled ends of the impact bumpers are attached to swivel head screws secured to the inside wall of the outer impact shield;

wherein the keeper boxes are attached to the outside surface of the impact bumpers by rivets and each of the keeper boxes contain one of the steel lugs and a spring that is configured to deflect and repel impact forces; and wherein each of the separate sections of the inner liner impact shield comprises two straps connected to a top of each of the separate sections and to a strapped pad configured to rest on top of a wearer's head when the helmet system is worn.

* * * * *